US007473290B2

(12) United States Patent
Yang et al.

(10) Patent No.: US 7,473,290 B2
(45) Date of Patent: Jan. 6, 2009

(54) GREASY SOOT PURIFYING DEVICE

(76) Inventors: Wen-Lung Yang, P.O. Box 697, Fongyuan City, Taichung County (TW) 420; Ying-Tsung Chen, P.O. Box 697, Fongyuan City, Taichung County (TW) 420

( * ) Notice: Subject to any disclaimer, the term of this patent is extended or adjusted under 35 U.S.C. 154(b) by 434 days.

(21) Appl. No.: 11/341,423

(22) Filed: Jan. 30, 2006

(65) Prior Publication Data

US 2007/0175184 A1 Aug. 2, 2007

(51) Int. Cl.
*B01D 46/00* (2006.01)

(52) U.S. Cl. ..... 55/385.3; 55/282.32; 55/282.2; 55/DIG. 28; 55/DIG. 30; 123/198 E; 126/299 D; 126/299 E

(58) Field of Classification Search ..... 55/385.3, 55/DIG. 30, DIG. 36, 282.3, 282.2; 123/198 E; 126/299 D, 299 E
See application file for complete search history.

(56) References Cited

U.S. PATENT DOCUMENTS 3,957,471 A * 5/1976 Tamachi et al. ..... 55/396
4,098,582 A * 7/1978 Takeda ..... 23/293 R
6,196,115 B1 * 3/2001 Tsao ..... 99/339
6,895,954 B2 * 5/2005 Swierczyna et al. ..... 126/299 E
7,175,681 B2 * 2/2007 Hatanaka ..... 55/282.3
2007/0221191 A1 * 9/2007 O'Brien et al. ..... 126/25 R

* cited by examiner

*Primary Examiner*—Jason M Greene
*Assistant Examiner*—Minh-Chau T Pham

(57) ABSTRACT

A greasy soot purifying device includes a dome bottom in a bearer inside an exhaust pipe of a smoking exhauster, an automobile, a motorcycle and/or a factory which is equipped with a smoking exhausting device, a perforated circular steel plate on the top connected to the bottom by a pair of arcuate conductive rods which is converged with a power source and a temperature sensor disposed on an outer periphery of said bottom. When the greasy soot exhausts through the perforations of the steel plate which produce a temperature up to 500° C., it will be in repeated instantaneous combustion to be gasified and purified as the fresh air and when the temperature becomes higher than the predetermined degree, the temperature sensor will be functioned to break off the electric current until the temperature returned to it predetermined degree.

7 Claims, 5 Drawing Sheets

GREASY SOOT PURIFYING DEVICE

BACKGROUND OF THE INVENTION

The present invention relates to smoking exhausters and more particularly to a greasy soot purifying device which is capable of purifying the root exhausted from the smoking exhausters, the automobiles and etc., by repeated high temperature gasification.

Conventional smoking exhauster is capable of exhausting the greasy soot out of the kitchen for preventing the soot from inhaling into the human body especially for the cookers who fry the dishes with pork oil, peanut oil and/or other oils which heightens the possibility of catching the lung diseases and which is worse than that of the secondary smoking. The frying oils always have the temperature up to 200° C. the greasy soot volatilized from it has unexpected changeability in which includes the fragrant ammonia and N-PAHs that cause respiratory organs problem to the house holders who expose in the kitchen without a smoking exhauster. These women without using a smoking exhauster has 8-fold dangerous than those use the smoking exhauster on catching the lung cancer. That may be higher for a female cooker. The grain of the fragrant ammonia is less than 0.01 micrometer. Nobody can stop from inhaling into the respiratory organs. In the downtown section where the houses are systemically arranged. If every family are simultaneously exhausting the soot into the air which will be severely contaminated in addition to the automobiles which exhaust the carbon dioxide in the streets contaminating the environment. So that is no way to do except purifying the source of stains.

SUMMARY OF THE PRESENT INVENTION

The present invention has a main object to provide a greasy soot purifying device which is capable of repeated instantaneous combustions of the soot by high temperature to purify the soot into fresh air.

Another object of the present invention is to provide a greasy soot purifying device which is structured by a plurality of heating pipes and will break with the power source when reaches to a predetermined high temperature.

Still another object of the present invention is to provide a greasy soot purifying device which fits to every type of the smoking exhausters no matter of whether it is used in a family and/or a restaurant.

Further object of the present invention is to provide a greasy soot purifying device which is capable of purifying a large, medium or small amount of the soot.

Still further object of the present invention is to provide a greasy soot purifying device which fits to use in the automobiles, the motorcycles and/or the factories.

Accordingly, the greasy soot purifying device is of a set of perforated steel plates or of high temperature heating pipes disposed in the exhaust pipe of a smoking exhauster and/or an automobile. The soot or the carbon dioxide is burned repeatedly by high temperature to become fresh air.

The present invention will become more fully understood by reference to the following detailed description thereof when read in conjunction with the attached drawings.

DETAILED DESCRIPTION OF THE PREFERRED EMBODIMENT

Figure 1:
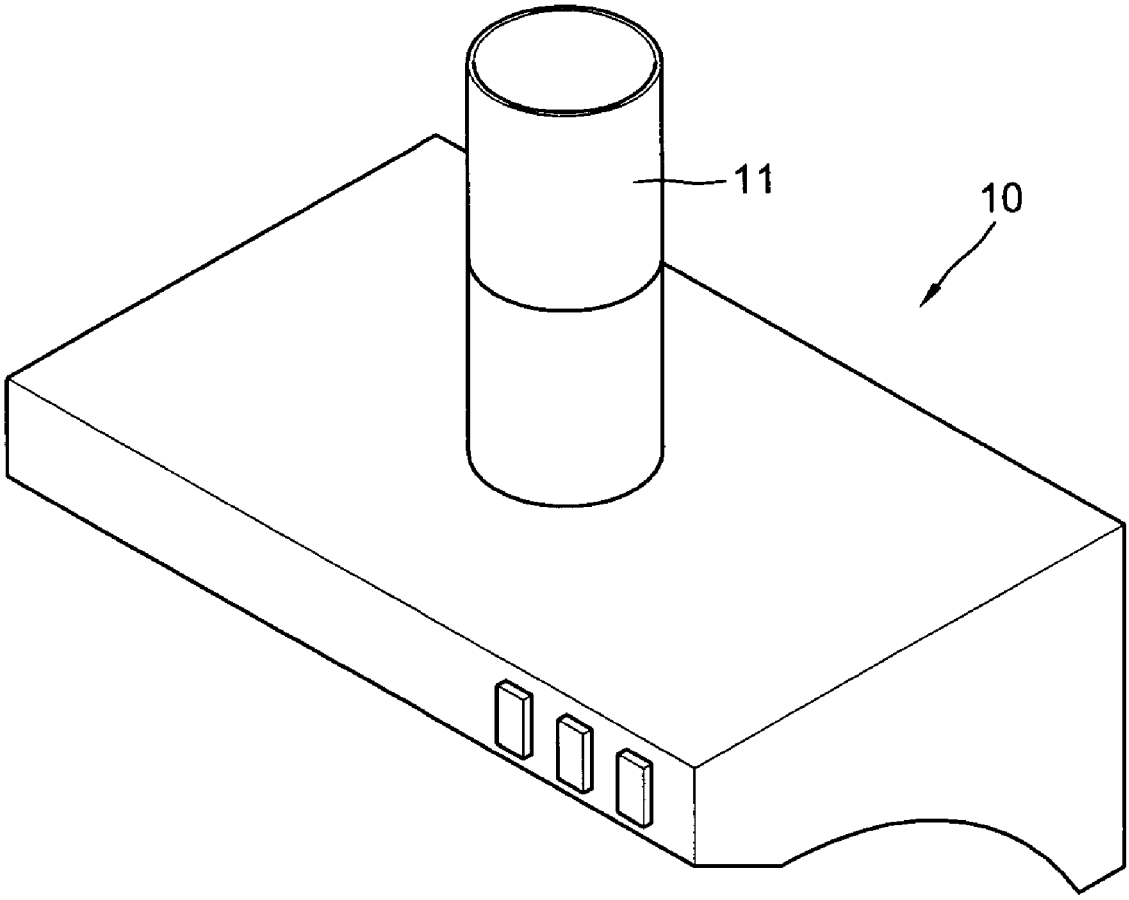
FIG. 1 is a perspective view to show the outlook of a smoking exhauster.
Figure 2:
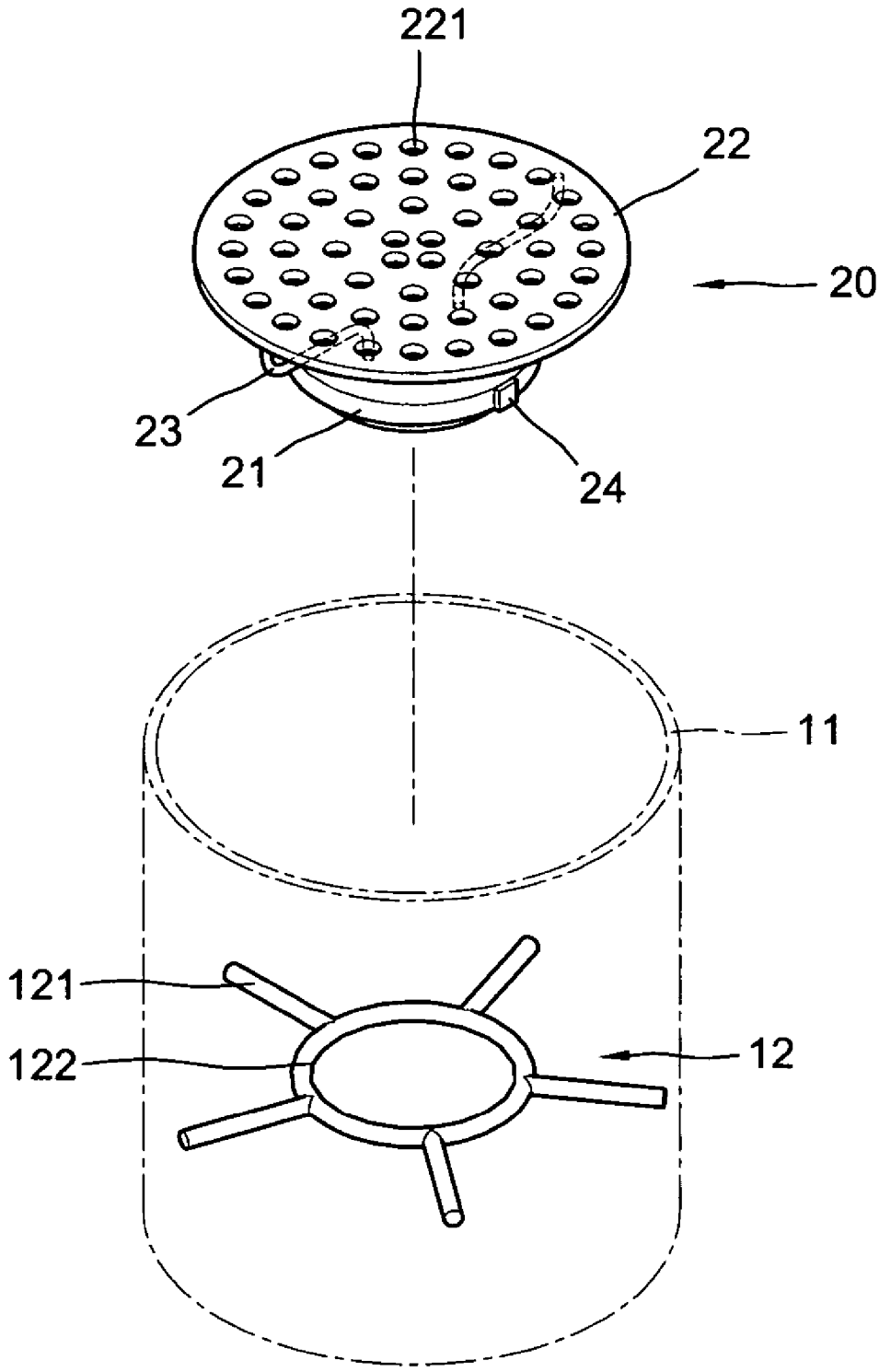
FIG. 2 is an exploded perspective view of the first embodiment of the greasy soot purifying device of the present invention.
Figure 3:
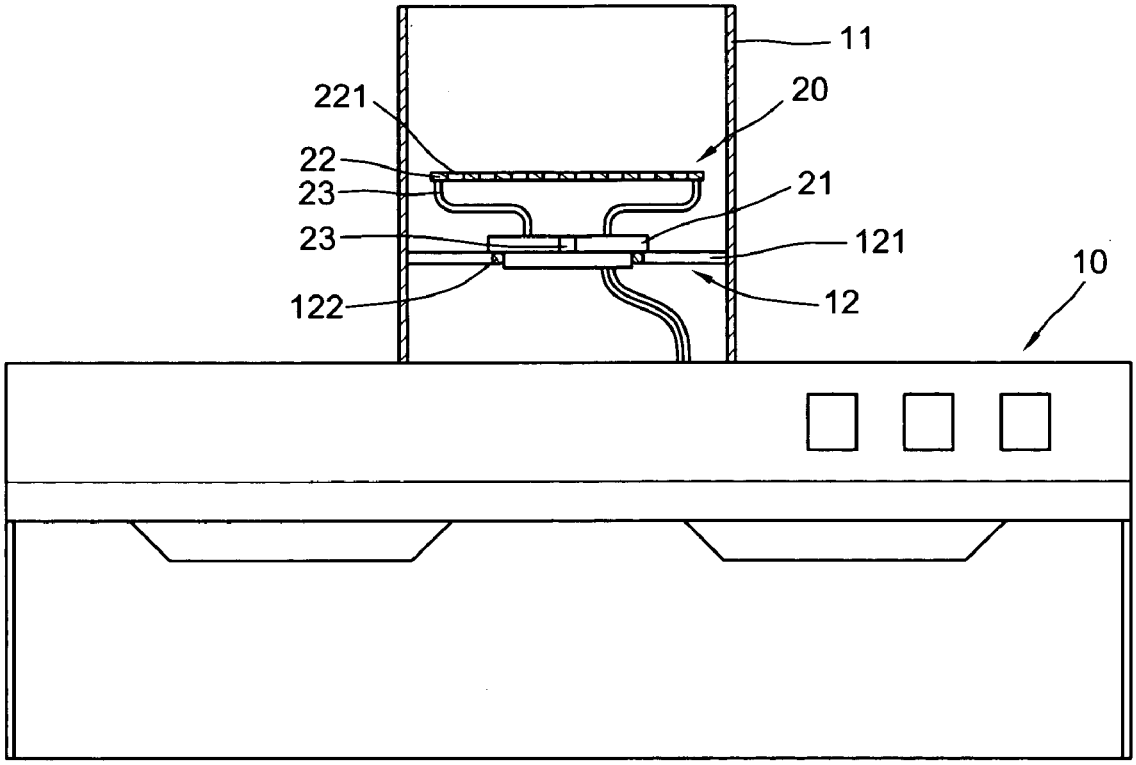
FIG. 3 is a sectional view to show the greasy soot purifying device of FIG. 2 in an exhaust pipe of a smoking exhauster.

With reference to the drawings and initiated from FIGS. 1 to 3, the first embodiment of the greasy soot purifying device 20 of the present invention is disposed into an exhaust pipe 11 of a smoking exhauster 10 which may be installed in a family kitchen, a factory and a site where exhausts the greasy soot and/or the exhaust pipe of the automobile, the motorcycles and etc. Inside the exhaust pipe 11 there is a bearer 12 which includes a positioning ring 122 in the center connected to the inner periphery of the exhaust pipe 11 by a plurality of support rods 121. The greasy soot purifying device 20 is a high temperature electric heater and composed of a dome bottom 21, a perforated circular steel plate 22 on the top having a plurality of perforations 221 in the entire surface, a pair of conductive rods 23 inserted through the dome bottom 21 and terminated on opposite side of the circular steel plate 22 and connected to a power source (not shown) and a temperature sensor 24 disposed on an outer periphery of the dome bottom 21 which is made of insulation material such as the ceramic and inserted into the positioning ring 122 of the bearer 12. The perforated circular steel plate 22 is capable to produce above 500° C. high temperature. When the temperature of the steel plate 22 is found higher than the predetermined temperature, the sensor 24 is functioned to shut off the electric current until the temperature returned to normal state.

This type of the greasy soot purifying device 10 fits to the family sized smoking exhauster which exhausts a medium amount of the greasy soot. When the greasy soot passes through the purifying device 20, it will be in repeated instantaneous combustion by the high temperature of the perforated circular steel plate 22 and gasified into fresh air exhausting to outside of the kitchen. So that the soot is therefore purified. When the temperature of the steel plate 22 is over the predetermined high. The sensor 24 is functioned to shut off the electric current until the temperature returned to its normal state.

Figure 4:
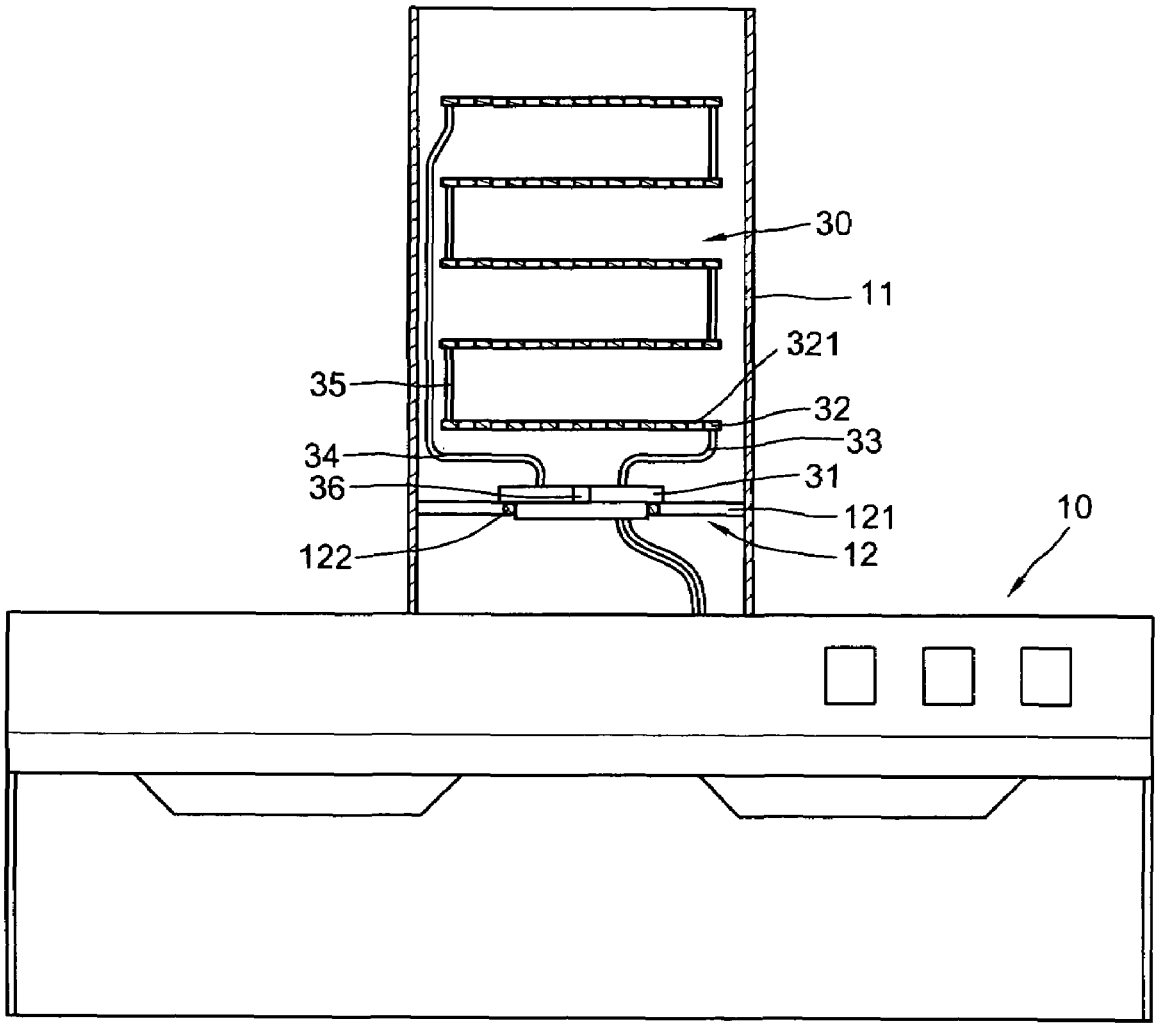
FIG. 4 is a sectional view to show a second embodiment of the greasy soot purifying device of the present invention.

Referring to FIG. 4 which shows a second embodiment of the greasy soot purifying device 30 of the present invention. This embodiment is functionally and structurally most similar to the, first embodiment as describes in FIGS. 1 to 3 and above discussions are applicable inmost instance. For example, the greasy soot purifying device 30 is still disposed onto the bearer 12 inside the exhaust pipe 11 of the smoking exhauster 10. The purifying device 30 comprises a dome bottom 31 inserted into the positioning ring 122 and a plurality of perforated circular steel plates 32 on the top, a pair of actuate conductive rods 33 and 34 alternately connected to an uppermost and a lowermost plates 32 and incorporatedly extended from the bottom 31 to a power source then to connect a right side of the lowermost steel plate 32 and left side of a upper most plate 32. The to connect other steel plate 32 are alternately connected by a plurality of straight conductive rods 35 and a temperature sensor 36 is disposed at the predetermined position of the purifying device 30.

This arrangement of multiple superimposed steel plates 32 aims to handle a large amount of the greasy soot. After the greasy soot is under instantaneous combustion repeatedly by several pieces of the perforated steel plate 32 it is almost completely gasified and purified as the fresh air.

Figure 5:
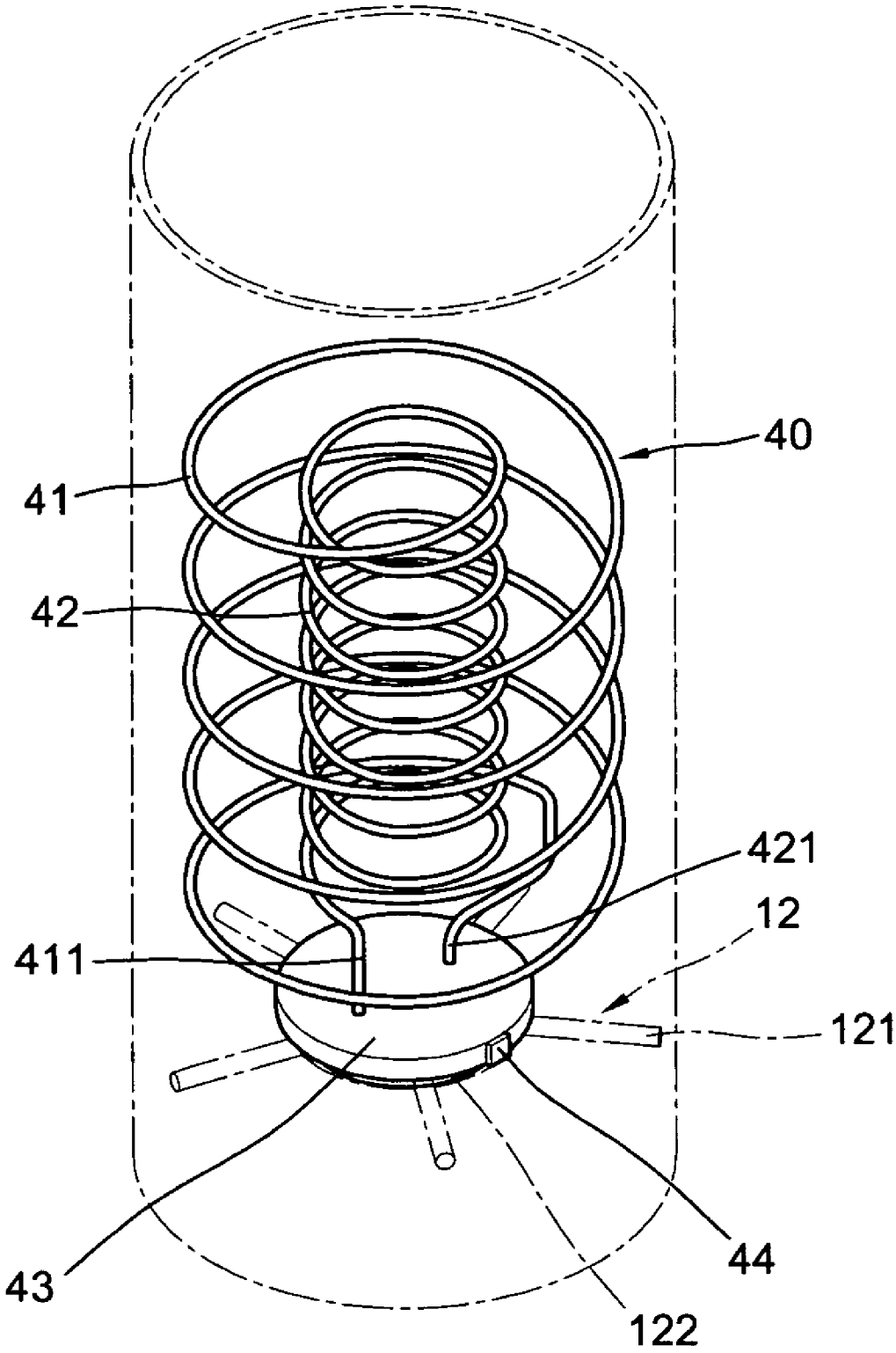
FIG. 5 is a perspective view of a third embodiment of the greasy soot purifying device of the present invention.

FIG. 5 shows a third embodiment of the greasy soot purifying device 40 of the present invention which fits to purify small amount of the greasy soot (for instance, the kitchen is used to perform steam cook and scarcely cooking the fried-dishes) and is composed of a plurality of large spiral circular heat pipes 41 connecting and surrounding a plurality of small spiral circular heating pipes 42, each having a lower end 411 and 421 respectively embedded into a dome bottom 43 and a heat sensor 44 on an outer periphery of the bottom 43. Meanwhile, the positioning ring 122 and the support rods 121 of the bearer 12 remain unchanged. When the small amount of greasy soot exhausts through the large and the small spiral circular heat pipes 41 and 42 and by the repeated instantaneous combustions, it also be gasified and purified as the fresh air.

The above discussed embodiments of the greasy soot purifying device 20, 30 and 40 fit to any type the smoking exhausters. The users only choose the suitable type of above greasy soot purifying device installed into the exhaust pipe of their smoking exhauster. The purifying of the greasy soot will be achievable. Besides, this purifying device is also adaptable to the automobile, the motorcycles and the factories if they have the smoking exhausting equipment. So that the contaminations in the air will greatly decreased.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

We claim:

1. A greasy soot purifying device comprising: a greasy soot purifying device disposed on a bearer of an exhaust pipe, said device comprising a dome bottom connected to a perforated circular steel plate by a pair of actuate conductive rods which are converged in said dome bottom and connected with a power source, and said dome bottom having a temperature sensor fixed on an outer periphery thereof.

2. The purifying device as recited in claim 1, wherein said dome bottom is made of ceramic material.

3. The purifying device as recited in claim 1, wherein said steel plate has a plurality of perforations in entire surface.

4. The purifying device as recited in claim 1, wherein said bearer is composed of a positioning ring spacedly connected to inner periphery of said exhaust pipe by a plurality of support rods.

5. The purifying device as recited in claim 1, wherein said exhaust pipe belongs to a smoking exhauster, an automobile, a motorcycle and/or a factory where has smoking exhaust equipment.

6. A greasy soot purifying device comprising: a dome bottom disposed to a bearer inside an exhaust pipe of a smoking exhauster, an automobile, a motorcycle and a factory, a plurality of spaced perforated circular steel plates on top alternately connected by a plurality of third conductive straight rods with a pair of uppermost and lowermost steel plates alternately connected by a pair of actuate conductive rods which are embedded and converged in said dome bottom and connected with a power source, and a temperature sensor on an outer periphery of said dome bottom which is made of ceramic material.

7. A greasy soot purifying device comprising: a dome bottom disposed into a bearer inside an exhaust pipe of a smoking exhauster, an automobile, a motorcycle and a smoking exhaust equipment of a factory and made of ceramic material, a plurality of large spiral circular heat pipes surrounding a plurality of small spiral circular heating pipes extended upward from top of said dome bottom with their lower end embedded and converged in said dome bottom and then connected to a power source, and a temperature sensor disposed on an outer periphery of said dome bottom.

* * * * *